US011771226B2

(12) United States Patent
Galiotto et al.

(10) Patent No.: US 11,771,226 B2
(45) Date of Patent: Oct. 3, 2023

(54) RECLINING CHAIR

(71) Applicant: NARDI S.P.A., Chiampo (IT)

(72) Inventors: Raffaello Galiotto, Chiampo (IT); Giampietro Nardi, Chiampo (IT)

(73) Assignee: NARDI S.P.A., Chiampo (IT)

( * ) Notice: Subject to any disclaimer, the term of this patent is extended or adjusted under 35 U.S.C. 154(b) by 0 days.

(21) Appl. No.: 17/757,725

(22) PCT Filed: Dec. 18, 2020

(86) PCT No.: PCT/IB2020/062208
§ 371 (c)(1),
(2) Date: Jun. 20, 2022

(87) PCT Pub. No.: WO2021/130635
PCT Pub. Date: Jul. 1, 2021

(65) Prior Publication Data

US 2023/0020288 A1 Jan. 19, 2023

(30) Foreign Application Priority Data

Dec. 23, 2019 (IT) ..... 102019000025363

(51) Int. Cl.
*A47C 1/024* (2006.01)
*A47C 1/026* (2006.01)
(Continued)

(52) U.S. Cl.
CPC ..... *A47C 1/0265* (2013.01); *A47C 1/024* (2013.01); *A47C 1/026* (2013.01);
(Continued)

(58) Field of Classification Search
CPC ..... A47C 1/0265; A47C 1/024; A47C 1/026; A47C 1/03205; A47C 1/03261;
(Continued)

(56) References Cited

U.S. PATENT DOCUMENTS 125,757 A * 4/1872 Quirolo ..... A47C 7/443
297/359
685,371 A * 10/1901 Sturm ..... A47C 1/026
16/326

(Continued)

FOREIGN PATENT DOCUMENTS

GB 640805 A 7/1950

OTHER PUBLICATIONS

International Search Report and Written Opinion for Corresponding International Application No. PCT/IB2020/062208, 11 pages, dated Feb. 1, 2021.

*Primary Examiner* — Robert Canfield
(74) *Attorney, Agent, or Firm* — Lucas & Mercanti, LLP

(57) ABSTRACT

A reclining chair having a seat, backrest and armrest is provided. The armrest has a first portion associated with the seat and a second portion associated with the backrest. The first and second armrest portions are slidable relative to each other between a first position associated with a raised backrest and a second position associated with a reclined configuration. The armrest also has a locking mechanism of the sliding between the first and second armrest portions, and the locking mechanism has first and second locking seats and a locking element configured to couple alternatively to the first-or to the second locking seat. A coupling of the locking element to the first locking seat is associated with the first position and a coupling of the locking element to the second locking seat is associated with the second position.

12 Claims, 3 Drawing Sheets

(51) Int. Cl.
*A47C 1/032* (2006.01)
*A47C 3/12* (2006.01)
*A47C 5/12* (2006.01)

(52) U.S. Cl.
CPC ..... *A47C 1/03205* (2013.01); *A47C 1/03261* (2013.01); *A47C 1/03272* (2013.01); *A47C 3/12* (2013.01); *A47C 5/12* (2013.01)

(58) Field of Classification Search
CPC ..... A47C 1/03272; A47C 3/12; A47C 5/12; A47C 1/14; A47C 7/44; A47C 7/443
USPC ..... 297/285, 286, 287, 289, 299
See application file for complete search history.

(56) References Cited

U.S. PATENT DOCUMENTS

| | | | | |
|---|---|---|---|---|
| 2,099,460 | A | 11/1937 | Bell | |
| 2,690,793 | A | 10/1954 | Pederson et al. | |
| 2,760,559 | A | 8/1956 | Edwin | |
| 4,056,115 | A * | 11/1977 | Thomas | A45B 7/00 403/322.2 |
| 11,000,127 | B1 * | 5/2021 | Wu | A47C 1/03244 |
| 2021/0219724 | A1 * | 7/2021 | Chen | A47C 4/22 |
| 2021/0219731 | A1 * | 7/2021 | Chen | A47C 9/002 |

* cited by examiner

RECLINING CHAIR

CROSS-REFERENCE TO RELATED APPLICATIONS

This application is a 371 of PCT/IB2020/062208, filed Dec. 18, 2020, which claims the benefit of Italian Patent Application No. 102019000025363, filed Dec. 23, 2019.

FIELD OF THE INVENTION

The present disclosure generally refers to the field of chairs. More particularly, the present disclosure refers to a reclining chair in which a backrest of said reclining chair can assume at least a first configuration raised with respect to a seat and a second configuration reclined with respect to the seat itself.

BACKGROUND OF THE INVENTION

Generally, known chairs comprise a seat portion traditionally supported by four legs and a back portion associated with said seat portion.

To make the chairs comfortable and convenient on every occasion, over the years chairs in which the position of the backrest with respect to the seat is variable have been developed. For example, the backrest can assume a raised configuration with respect to the seat and a reclined position with respect to the seat itself. In other words, the angle between the backrest is variable. Specifically, this angle is greater when the backrest is in a reclined configuration than when the backrest itself is in a raised position.

The known reclining chairs traditionally comprise a pin arranged between the seat and the backrest in such a way that said backrest can rotate with respect to said pin to change the angle between the backrest itself and the seat.

The known reclining chairs further comprise a mechanism for adjusting the reclining of the backrest. Traditionally, this adjustment mechanism is arranged externally to a chair frame.

In many known reclining chairs, the adjustment mechanism consists of a metal element hinged to the backrest and configured to abut on a toothed guide associated with a leg of the chair itself.

Consequently, especially in the case of chairs intended for outdoor use, the adjustment mechanism is exposed to atmospheric agents.

In particular, high temperature changes, but especially rain and snow can damage this adjustment mechanism, compromising the integrity of the entire reclining chair and exposing a user to the risk of injury.

Furthermore, with the aforesaid adjustment mechanisms, a modification of the position of the backrest with respect to the seat requires that a user seated in the reclining chair stands up from the chair itself and manually modifies the position of the backrest.

SUMMARY OF THE INVENTION

The present disclosure aims to provide a reclining chair and a method for modifying the configuration of a reclining chair which allow to overcome the drawbacks mentioned above with reference to the known art and/or to achieve further advantages.

This is achieved through a reclining chair and a process as defined in the respective independent claims. Secondary features and particular embodiments of the object of this disclosure are defined in the corresponding dependent claims.

The reclining chair according to the present disclosure comprises a seat, a backrest associated with said seat and at least one armrest. The armrest comprises a first armrest portion associated with the seat and a second armrest portion associated with the backrest. In particular, the first armrest portion and the second armrest portion are sliding relative to each other between at least a first position associated with a raised configuration of the backrest with respect to the seat and a second position associated with a reclined configuration of the backrest with respect to the seat. Furthermore, the armrest comprises a locking mechanism of the sliding between the first armrest portion and the second armrest portion. The locking mechanism comprises a first locking seat, a second locking seat and a locking element configured to alternately couple to the first locking seat or to the second locking seat. In detail, a coupling of the locking element to the first locking seat is associated with the first armrest position and a coupling of the locking element to the second locking seat associated with said second armrest position.

Consequently, the variation of the configuration of the backrest with respect to the seat takes place by intervening on the locking mechanism located in the armrest.

Preferably, according to a preferred aspect, the first locking seat and the second locking seat are not directly accessible by a user. Advantageously, therefore, any risks of accidents are reduced or eliminated.

Furthermore, the locking mechanism includes a spring or elastic element, which is adapted to be arranged in a loading condition when the locking element is in the second locking seat, that is, when the backrest is in the reclined position. In this way, by removing the locking element from the second locking seat, the spring or elastic element independently brings the locking element back into the first locking seat, and the backrest is repositioned in the first position.

It follows that, advantageously, this modification of the configuration of the back does not require a user to stand up from the reclining chair itself.

It follows that it is not just a locking mechanism. Indeed, the mechanism inside the armrest has a double value: locking and operating.

Unlocking the locking element from the first locking seat to the second locking seat allows the user to push the backrest with his back and bring the backrest from the raised to the reclined position. This action simultaneously allows the internal spring mechanism to be loaded.

The spring mechanism, after unlocking, will release the accumulated energy by automatically returning the backrest from the reclined to the raised position without further forcing by the user. Furthermore, the user can perform said movement while remaining seated.

Preferably again, at a front area of the armrest, preferably at a curve area between a front leg and the armrest, the armrest has a reduction of thickness such that a localized elastic deformation capable of modifying the leg-armrest layout is allowed without the use of visible pins and mechanical hooks to allow the rotation of the two leg-armrest parts. This movement is a limited rotation which however helps in the movement of the backrest from one position to another.

According to a preferred aspect of the present disclosure, one of the first armrest portion and the second armrest portion is a tubular body while the other between the first armrest portion and the second armrest portion is a body at least partially inserted in the tubular body and configured to slide along a sliding direction.

Furthermore, according to a preferred aspect of the present disclosure, the locking mechanism is inserted inside the armrest. In particular, the tubular body defines an internal zone of the tubular body itself and the locking mechanism is arranged in this internal zone. Advantageously, therefore, this locking mechanism is not exposed to atmospheric agents. It follows that the reclining chair according to the present disclosure has an improved reliability.

Preferably again, said seat and said backrest form a single body, and/or said seat and said backrest are connected to each other without solution of continuity and/or in which said seat and said backrest are connected to each other without pivot elements or hinge elements. Basically, the backrest is made of plastic material which is stretched or brought under slight tension when passing from the raised position to the raised position. In other words, the chair has an L-shaped section with a rounded corner, and is deformed between the two positions. This aspect of the single body together with the characteristic that the whole mechanism is contained in the armrest, allows to avoid visible mechanisms, and to give the chair a less technical and more design aspect.

Furthermore, this aspect of the single body is advantageous due to the fact that the accumulation of energy necessary for the movement, from the reclined to the raised position, is obtained jointly by the elastic element inside the mechanism and by the stretching of the plastic backrest which from its natural L-folded shape is forced into the more open position.

According to a further preferred aspect of the present disclosure, the tubular body comprises a first abutment element, while the body inserted in the tubular body comprises a second abutment element. Said first and second abutment elements are arranged aligned along a main direction of development of the tubular body and are arranged so as to define a sliding stop of the tubular body with respect to the inserted body. Consequently, a complete exit of the body inserted in the tubular body is prevented.

According to another preferred aspect of the present disclosure, the elastic element or spring is interposed between the first abutment element and the second abutment element to counteract an exit of the body inserted from the tubular body. In other words, the elastic element exerts on the inserted body a force opposite to an exit direction of the body inserted from the tubular body. This elastic element also facilitates the insertion of the body inserted in the tubular body, thus favoring the transition from the reclined configuration to the raised configuration of the backrest, as indicated above.

According to a further preferred aspect of the present disclosure, the first seat and the second seat of the locking mechanism are through holes defined in the tubular body. The locking element is instead associated with the inserted body. Consequently, an insertion of the locking element of the body inserted in one of said seats of the locking mechanism is facilitated. Furthermore, according to this aspect, an uncoupling of the locking element from one of said seats is also facilitated. This uncoupling can in fact be carried out by exerting a pressure force on said locking element through the through hole of said first or second seat.

Furthermore, according to a preferred aspect of the present disclosure, the locking element comprises a first part associated with the inserted body and a second part configured to couple alternately with the first seat and the second seat. In particular, the second part is movable with respect to the first part from a retracted position to an extended position. In this extended position, the second part is at least partially inserted in the first seat or in the second seat, while in the retracted position the second part of the locking element is completely inserted in the tubular body. Preferably, between the first part and the second part of the locking element there is a second elastic element configured to keep the second part of the locking element in the extended position. In particular, the second elastic element exerts a removal force on the second part of the locking element with respect to the first part of the locking element. Consequently, according to these aspects, the coupling and uncoupling of the locking element in one of said seats for locking or unlocking the backrest in/from one of the reclined configuration and the raised configuration are further facilitated. In particular, to uncouple the locking element from one of said seats, it is sufficient to exert a pressure on the second part of the locking element in such a way as to counteract the removal force exerted by the second elastic element in order to make the second part come out of the locking element from the first or second seat of the locking mechanism.

According to a preferred aspect of the present disclosure, the tubular body comprises an activation device configured to move the second part of the locking element from the extended position to the retracted position. In particular, the activation device comprises a first activation element arranged at the first seat, and a second activation element arranged at the second seat. Consequently, the uncoupling of the locking element from one of said seats can take place through this activation device, thus avoiding possible injuries for a user. Preferably, this activation element is arranged so as to cover the first seat and the second seat so as to prevent access to said first seat and second seat by a user.

In particular, according to a preferred aspect, the activation device is a tilting body hinged on a pin arranged between the first and second seat and configured to oscillate around said pivot so that the first activation element can abut against the second part of the locking element at the first seat or that the second activation element abuts against the second part of the locking element at the second seat. In detail, preferably, the tilting body is configured to cover, or close, the first and second locking seat and, at the same time, to ensure that the first activation element and the second activation element can selectively abut respectively in the first seat and second seat. Even more particularly, according to a preferred aspect, the tilting body is configured so that the first activation element is arranged at the through hole of the first seat so that said through hole in the tubular body is not accessible by a user. Furthermore, according to this aspect, the tilting body is configured so that the second activation element is arranged at the through hole of said second seat so that this through hole in the tubular body is not accessible by a user.

According to a further preferred aspect of the present disclosure, the reclining chair further comprises a second armrest. This second armrest is identical to the first armrest, as defined above. Consequently, the locking of the backrest configuration in the raised configuration or in the reclined configuration is improved and made more secure and stable.

The present disclosure has as a further object a method for modifying the configuration of a backrest with respect to a seat of a reclining chair at least between a raised position of the backrest with respect to the seat to a reclined position of the backrest with respect to the seat itself, or vice versa. The method comprises a step of sliding, relative to each other, a first armrest portion and a second armrest portion of an armrest of the reclining chair between a first position associated with a raised configuration of the backrest with respect to the seat and a second position associated with a reclined configuration of the backrest with respect to the seat. In particular, the first armrest portion is associated with the seat, and the second armrest portion is associated with the backrest.

Consequently, the modification of the configuration of the backrest with respect to the seat, at least between the reclined position and the raised position of the backrest, can occur by intervening directly on the armrest, without a user having to stand up.

According to an aspect of the present disclosure, the method comprises a step of locking the sliding between the armrest portions in the first position or in the second position. This locking step provides for coupling a locking element of a locking mechanism to a first or to a second locking seat of the locking mechanism itself. Specifically, a coupling of the locking element to the first locking seat is associated with the first position, while a coupling of the locking element to the second locking seat is associated with the second position. Consequently, the backrest can be easily locked in the reclined configuration or in the raised configuration.

According to a further preferred aspect of the present disclosure, the coupling of the locking element to the first or to the second seat occurs by moving a second part of the locking element with respect to a first part of the locking element itself, from a retracted position to an extended position of the second part of the locking member. This movement occurs through an elastic element interposed between the first and second part of the locking element. Consequently, the locking of the sliding between the armrest portions, or between the tubular body and the inserted body occurs automatically when the locking element is located at the first or second seat.

According to a further preferred aspect of the present disclosure, the method provides for an unlocking step of the sliding between the first armrest portion and the second armrest portion so as to pass from the raised position of the backrest to the reclined position thereof or vice versa.

Preferably, according to an aspect of the present disclosure, the unlocking step takes place by moving the second part of the locking element with respect to the first part of the locking element itself from the extended position to the retracted position. This movement occurs by compressing the second elastic element, preferably by means of an actuation device.

Further advantages, characteristics and methods of use of the object of the present disclosure will become apparent from the following detailed description of its embodiments, presented by way of non-limiting example.

However, it is clear that each embodiment of the object of the present disclosure can present one or more of the advantages listed above; however, each embodiment is not required to simultaneously present all the listed advantages.

BRIEF DESCRIPTION OF THE DRAWINGS

Reference will be made to the figures of the attached drawings, in which.

DETAILED DESCRIPTION OF THE INVENTION

With reference to the attached figures, an embodiment of a reclining chair according to the present disclosure is indicated with the reference number 100.

With the expression "reclining chair" we mean, in the context of this disclosure, a chair in which a backrest of the chair can assume at least a raised position and a reclined position with respect to the seat.

Figure 1:
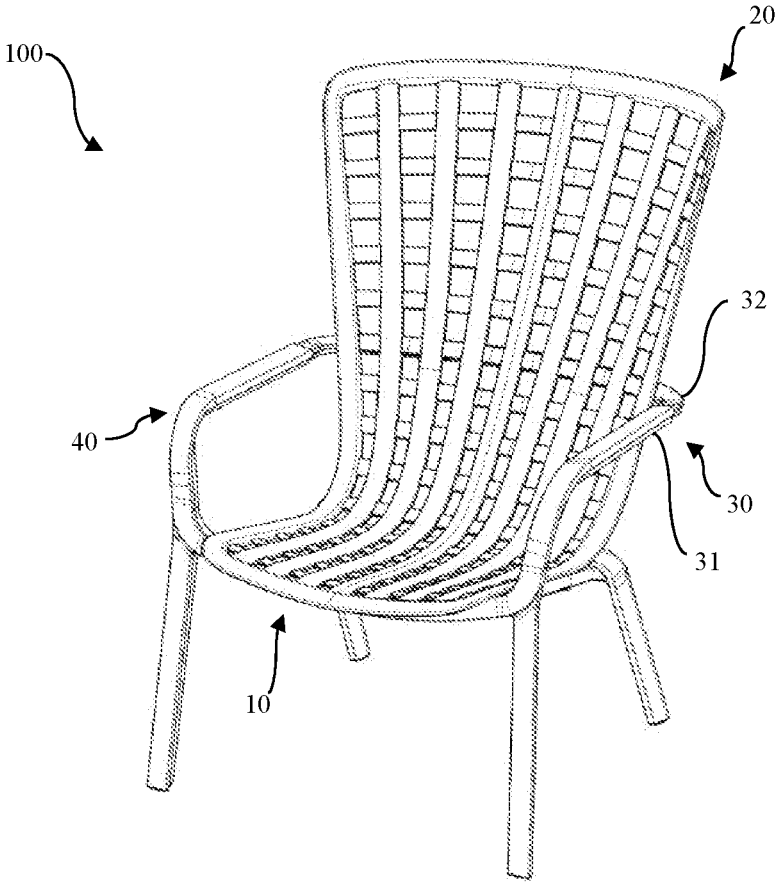
FIG. 1 represents a perspective view of a reclining chair according to an embodiment of the present disclosure.
Figure 2:
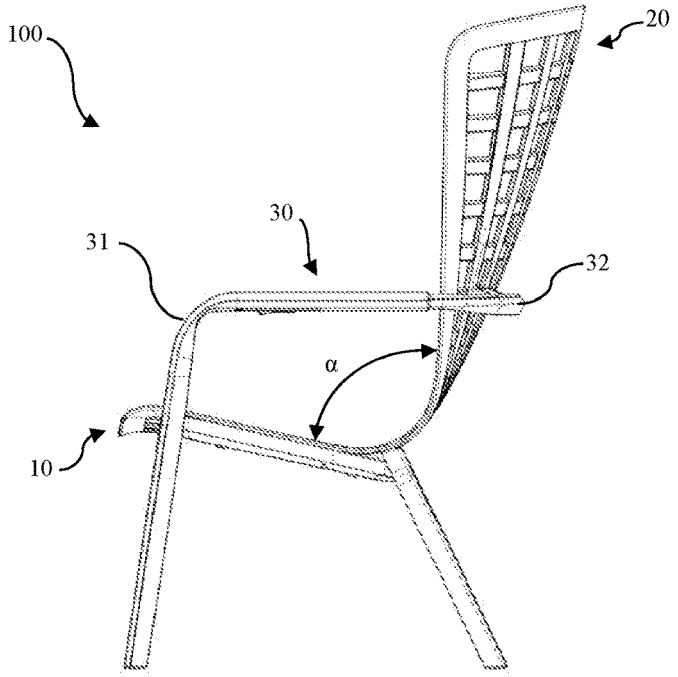
FIG. 2 shows a side view of a reclining chair according to an embodiment of the present disclosure, in which the backrest is in a raised position.
Figure 3:
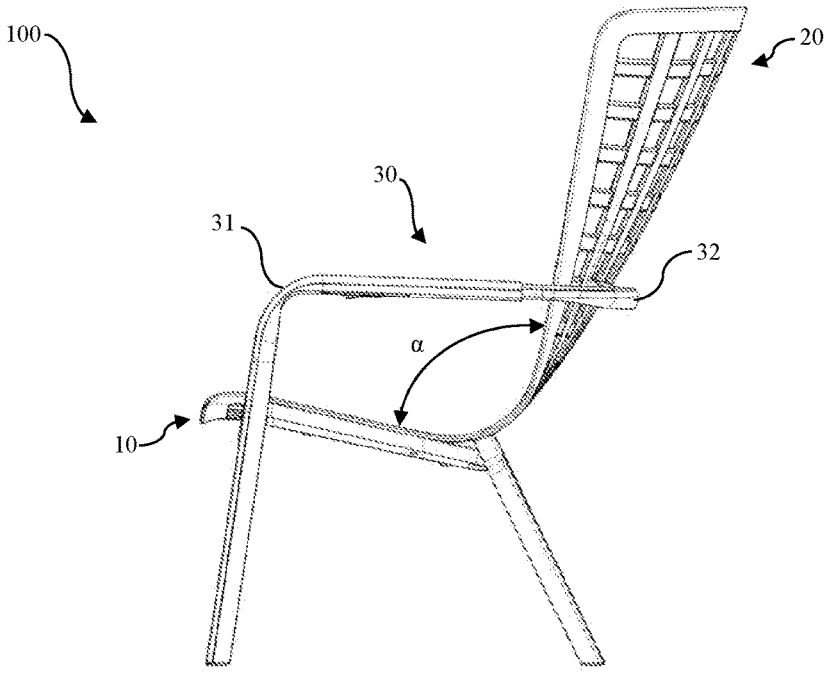
FIG. 3 shows a side view of a reclining chair according to an embodiment of the present disclosure, in which the backrest is in a reclined position.

In particular, as visible in FIGS. 1 to 3, the reclining chair 100 according to the present disclosure comprises a seat 10 and a backrest 20. The seat 10 is configured, in use, to support the weight of a user, while the backrest 20 it is configured to support the back of a user in order to guarantee comfort for the user.

Preferably, the seat 10 and the backrest 20 form a single body. In other words, seat 10 and back 20 form a continuous or seamless surface. Stated otherwise, the reclining chair 100 according to the present disclosure is devoid of a pin or a mechanism for tilting the backrest 20.

According to the present disclosure, the position of the backrest 20 with respect to the seat 10 is variable. In particular, the backrest 20 can assume at least a first raised configuration with respect to the seat 10 and a second reclined configuration with respect to the seat 10 itself. In other words, an angle a between the seat 10 and the back 20 is variable. Specifically, said angle $\alpha$ is greater when the backrest is in a reclined configuration than when it is in a raised configuration.

In particular, FIG. 2 represents a side view of an embodiment of the reclining chair 100 according to the present disclosure, in which the backrest 20 is in a raised position with respect to the seat 10. FIG. 3 instead represents a side view of a form of realization of the reclining chair 100 according to the present disclosure, in which the backrest 20 is in a reclined position with respect to the seat 10. In this reclined configuration, the angle $\alpha$ is greater than that in the raised configuration shown in FIG. 2.

Preferably, the material with which the seat 10 and the backrest 20 are made allows the passage from said reclined configuration to said raised configuration or vice versa. In other words, the seat 10 and the backrest 20 are preferably made of an elastic material. A particularly suitable material is polypropylene, preferably filled with glass fiber.

The reclining chair 100 according to the present disclosure further comprises an armrest 30. In particular, this armrest 30 is associated both with said seat 10 and with said backrest 20.

Specifically, according to an aspect of the present disclosure, the armrest 30 comprises a first armrest portion 31 and a second armrest portion 32. The first armrest portion 31 is associated with the seat 10, while the second armrest portion 32 is associated with the backrest 20.

Furthermore, said first and second armrest portion 31, 32 are sliding relative to each other at least between a first position and a second position. In other words, at least one of the first armrest portion 31 and the second armrest portion 32 slides with respect to the other between said first armrest portion 31 and said second armrest portion 32 at least between a first position and a second position.

In particular, the first position of the armrest portions 31, 32 is associated with a raised configuration of the backrest 20 with respect to the seat 10, while the second position of the armrest portions 31, 32 is associated with a reclined configuration of the backrest 20 with respect to the seat 10.

According to a preferred aspect of the present disclosure, one between the first armrest portion 31 and the second armrest portion 32 is a tubular body, while the other between said first armrest portion 31 and said second armrest portion 32 is an inserted body at least partially in said tubular body. Preferably, the tubular body has a main direction of development L and the body at least inserted in the tubular body is configured to slide with respect to the tubular body itself along a sliding direction parallel to, or coinciding with, the main direction of development L of the tubular body.

For example, according to an embodiment, the first armrest portion 31 is a tubular, hollow or substantially hollow body, which at least partially accommodates the second armrest portion 32. This second armrest portion 32 is configured to slide inside a said first portion of armrest 31 at least between a first position and a second position.

Alternatively, the second armrest portion 32 is a tubular body, while the first armrest portion 31 is a body partially inserted in said tubular body and configured to slide within the tubular body.

Furthermore, as can be seen from the drawings, advantageously and preferably at the front leg-armrest curve, that is to say the first armrest portion 31, has a thinning of the thickness such that a localized elastic deformation is allowed, capable of modifying the layout of the leg-armrest without the use of visible pins and mechanical hooks to allow the rotation of the two leg-armrest parts. Even if a movement is minimal and not very perceptible as it is a limited rotation, it allows in a more facilitated way the movement of the backrest from one position to another.

According to the present disclosure, the armrest 30 further comprises a locking mechanism 50 of the sliding between the first armrest portion 31 and the second armrest portion 32.

Preferably, the locking mechanism 50 is arranged inside the armrest 30. In particular, according to a preferred aspect, the locking mechanism is arranged inside the tubular body. Said tubular body defines an internal zone of the tubular body itself and the locking mechanism 50 is arranged in said internal zone of the tubular body.

Specifically, the locking mechanism 50 comprises a first locking seat 51 and a second locking seat 52. Preferably, these locking seats 51, 52 are through holes defined in the tubular body. For example, the first locking seat and the second locking seat, 51 and 52 respectively, are each a through hole in the first armrest portion 51. Alternatively, if the second armrest portion 32 is a tubular body, said first locking seat 51 and said second locking seat 52 are through holes in said second armrest portion 32.

Furthermore, the locking mechanism 50 comprises a locking element 53 configured to alternatively couple to the first locking seat 51 or to the second locking seat 52. For example, the locking element 53 is a body configured to at least partially fit into the first locking seat 51 and in the second locking seat 52 in such a way as to block the sliding between the first armrest portion 31 and the second armrest portion 32. Preferably, the locking element 53 is associated with the inserted body. For example, the locking element 53 is associated, or integral with, the second armrest portion 32.

Specifically, a coupling of the locking element 53 to the first locking seat 51 is associated with the first position of the second armrest portion 32 with respect to the first armrest portion 31. Consequently, the coupling of the locking element 53 in the first seat block 51 is associated with a raised configuration of the backrest 20 with respect to the seat 10.

A coupling of the locking element 53 to the second locking seat 52 is instead associated with the second position of the second armrest portion 32 with respect to the first armrest portion 31. Consequently, the coupling of the locking element 53 in the second locking seat 52 is associated with a reclined configuration of the backrest 20 with respect to the seat 10.

Figure 4:
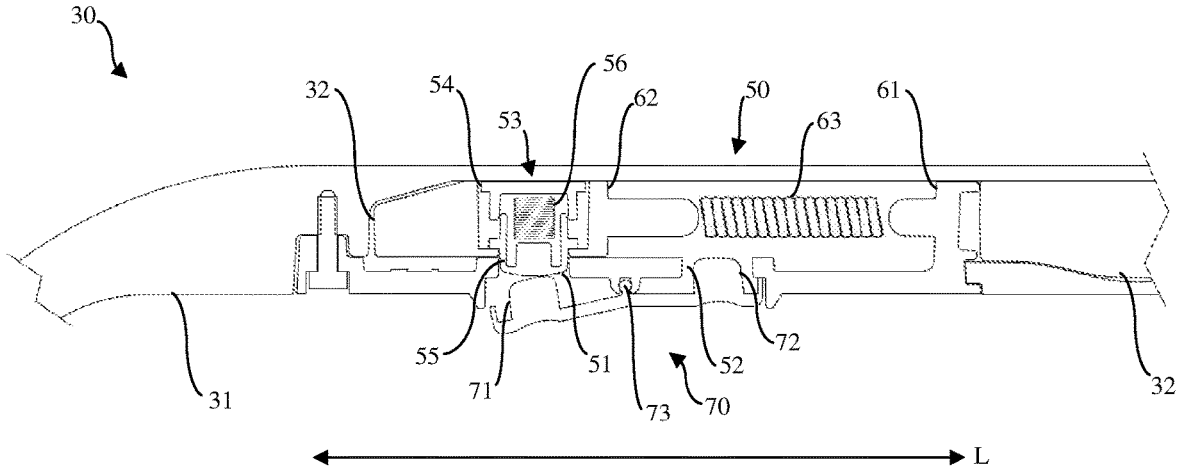
FIG. 4 shows a cross-section view of an armrest of a reclining chair according to an embodiment of the present disclosure in which a locking mechanism is visible in a first locking position.
Figure 5:
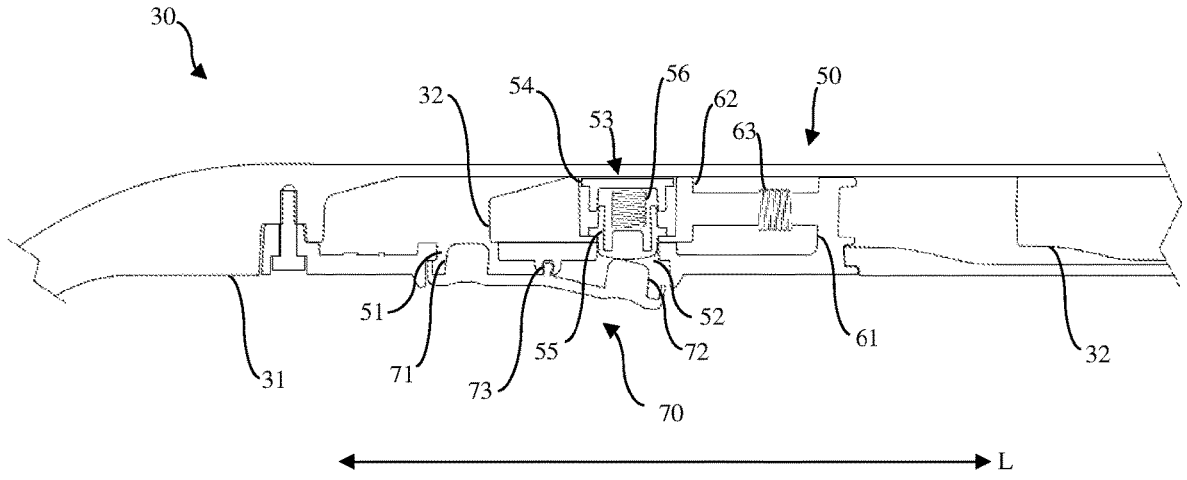
FIG. 5 shows a cross-section view of an armrest of a reclining chair according to an embodiment of the present disclosure in which a locking mechanism is visible in a second locking position.

With reference to FIGS. 4 and 5, FIG. 4 shows a section of an armrest 30 according to an embodiment of the present disclosure. In particular, the locking mechanism 50 is visible in which the locking element 53 is coupled to the first seat 51. FIG. 5 shows instead a section of the armrest 30 in which the locking mechanism 50 with the locking element is visible 53 coupled to the second seat 52.

In other words, when the locking element 53 is coupled with, or inserted into, the first locking seat 51, a relative sliding between the first armrest portion 31 and the second armrest portion 32 is prevented and the backrest 20 is locked in the raised configuration with respect to the seat 10.

Similarly, when the locking element 53 is coupled with or inserted in the second locking seat 52, a relative sliding between the first armrest portion 31 and the second armrest portion 32 is prevented and the backrest 20 is locked in the reclined configuration with respect to sitting 10.

Further, the locking mechanism includes a spring or resilient element 63, preferably a coil spring, which is adapted to be arranged in a loaded condition, when the locking element 53 is in the second locking seat, i.e. when the backrest is in the reclined position. In this way, by removing the locking element 53 from the second locking seat, the spring or elastic element 63 independently returns the locking element 53 to the first locking seat, and the backrest repositions itself in the first position. In practice, unlocking allows the user to force the backrest with his back and bring the backrest from the raised to the reclined position. This action simultaneously allows the internal spring mechanism to be wound.

The spring mechanism, after unlocking, will release the accumulated energy by automatically returning the backrest from the reclined to the raised position without further forcing by the user. Furthermore, the user can carry out said movement while remaining seated.

The accumulation of energy necessary for the movement, from the reclined to the raised position, is obtained jointly by the elastic element inside the mechanism and by an ironing of the plastic back which by its natural L-folded shape is forced into a more open position.

According to a preferred aspect of the present disclosure, the tubular body comprises a first abutment element 61, while the body inserted in said tubular body comprises a second abutment element 62. The first and second abutment elements 61, 62 are arranged aligned along the sliding direction, or the main direction of development L of the tubular body in such a way as to define a sliding stop between the tubular body and the body inserted in the tubular body.

For example, as can be seen in FIGS. 4 and 5, the first abutment element 61 is associated with the first armrest portion 31, while the second abutment element 62 is associated with the second armrest portion 32. The first abutment element 61 is positioned in such a way as to define an end of stroke for the sliding of the second armrest portion 32 with respect to the first armrest portion 31. In other words, the first and second abutment elements 61, 62 are positioned, or arranged, in such a way as to oppose an exit of the inserted body from the tubular body. In particular, the first and second abutment elements 61, 62 define a position of maximum exit, or of maximum sliding extension, of the body inserted by the tubular body. In this position of maximum release, the first abutment element 61 and the second abutment element 62 are in abutment with each other.

According to a further preferred aspect of the present disclosure, the aforementioned elastic element 63 is interposed between the first abutment element 61 and the second abutment element 62 and is configured to contrast an exit of the body inserted from the tubular body.

In particular, a coupling of the locking element 53 in the first locking seat 51 corresponds to an elongated configuration of the elastic element 63, as visible in FIG. 4, while a coupling of the locking element 53 in the second locking seat 52 corresponds to a compressed configuration of the elastic element 63, as visible in FIG. 5. In other words, the relative position of the first abutment element 61 and of the second abutment element 62 between which the elastic element 63 is interposed determines the configuration elongated or compressed of the elastic element 63 itself.

Consequently, as anticipated above, when the locking element 53 is uncoupled from the second locking seat 52, the elastic element 63 helps to change the configuration of the backrest from the reclined position to the raised position. In fact, the elastic element 63 promotes the insertion of the body inserted inside the tubular body, or a sliding of the second portion of the arm 32 inside the first portion of the arm 31.

Furthermore, when the backrest 10 is in a reclined position, given its arrangement and its conformation, the elastic element 63 favors a movement of the backrest 20 itself from the reclined position to the raised position. In other words, according to an embodiment, when the locking element 53 is uncoupled from the second locking seat 52, the elastic element 63 favors a sliding of the body inserted inside the tubular body, i.e. of the second armrest portion 32 at the inside of the first armrest portion 31.

According to a preferred aspect of the present disclosure, the locking element 53 comprises a first part 54 of a locking element 53 and a second part 55 of a locking element 53. The first part 54 is associated with the inserted body, for example, according to an embodiment, to the second armrest portion 31. The second part 55 of the locking element 53 is instead configured to couple alternatively to the first seat 51 or to the second seat 52 of the tubular body. In other words, according to an embodiment of the present disclosure, the second part 55 of the locking element 53 is configured to be inserted at least partially in the first seat 51 and in the second seat 53 of the first armrest portion 31.

Furthermore, the second part 55 of the locking element 53 is preferably movable with respect to the first part 54 of the locking element 53 itself. For example, the second part 55 is slidable with respect to the first part 54. Preferably, the movement of the second part 55 with respect to the first part 54 occurs along a direction of movement perpendicular to said sliding direction, or perpendicular to the main direction of development L of the tubular body.

In particular, the second part 55 is movable with respect to the first part 54 from a retracted position to an extended position. Specifically, in the extended position, the second part 55 of the locking element 53 is at least partially inserted in one between the first seat 51 and the second seat 52 of the locking mechanism 50, while in the retracted position the second part 55 of the element lock 53 is completely inserted in the tubular body.

In other words, an insertion of the second part 55 of the locking element 53 in the first seat 51 or in the second seat 52 determines a locking of the sliding between the tubular body and the inserted body, or between the first armrest portion 31 and the second armrest portion 32 and a consequent locking of the backrest in the raised or reclined position, respectively. In order to change the configuration of the backrest 20 it is necessary to uncouple the second part 55 of the locking element 53 from the first seat 51 or from the second seat 52, in such a way as to allow reciprocal sliding between the tubular body and the inserted body, or between the first armrest portion 31 and the second armrest portion 32.

Preferably, according to an aspect of the present disclosure, the reclining chair 100 comprises a second elastic element 56, for example a helical spring. This second elastic element 56 is interposed between the first part 54 of the locking element 53 and the second part 55 of the locking element 53 in such a way as to keep the second part 55 of the locking element 53 in the extended position.

In particular, when the second part 55 of the locking element 53 is coupled with, or inserted into, one of said first and second seats 51, 52 of the locking mechanism 50, the second elastic element 56 is in an elongated configuration, while when the second part 55 of the locking element 53 is completely inserted in the tubular body, that is, it is not engaged or coupled with a seat 51, 52, the second elastic element 56 is in a compressed configuration.

According to a further preferred aspect of the present disclosure, the tubular body further comprises an activation device 70. In other words, according to an embodiment, the activation device 70 is associated with the first armrest portion 31.

This activation device is configured to move the second part 55 of the locking element from the extended position to the retracted position. In this way, it is possible to unlock the sliding of the second armrest portion 32 with respect to the first armrest portion 31 in order to change the configuration of the backrest from the raised position to the reclined position, or vice versa.

Specifically, the activation device 70 comprises a first activation element 71 which is arranged at the first seat 51 of the locking mechanism 51, and a second activation element 72 which is instead arranged at the second seat 52 of the element locking element 50. Each of said first and second activation elements 71, 72 is configured to compress the second elastic element 56 so that the second portion 55 of the locking element 53 can be disengaged from one of said first and second seats 51, 52 of the locking mechanism 50.

Preferably, the activation device 70 is a tilting body hinged on a pin 73 arranged between the first seat 51 and the second seat 52 of the locking mechanism 50. Preferably, said first and second activation elements 71, 72 are arranged at opposite ends of said tilting body. The latter is configured to oscillate around said pin 73 so that the first activation element 71 abuts against the second part 55 of the locking element 53 at the first seat 51 or in such a way that the second activation element 72 abuts against the second part 55 of the locking element 53 at the second seat 52 of the locking mechanism 50.

In detail, the tilting body is configured to cover, or close, the first and second locking seats 51, 52 and, at the same time, to ensure that the first activation element 71 and the second activation element 72 can abut selectively respectively in the first seat 51 and in the second seat 52. Preferably the tilting body is configured so that the first activation element 71 is arranged at the through hole of the first seat 51 so that this through hole in the tubular body is not accessible by a user. Furthermore, according to this aspect, the tilting body is configured so that the second activation element 72 is arranged at the through hole of said second seat 52 so that this through hole in the tubular body is not accessible by a user. Advantageously, the first seat 51 and the second seat 52 are not accessible by a user, preferably through said tilting body which prevents direct access by a user to the first seat 51 and to the second seat 52, thus preventing the risk of pinching or accidents due to the through holes in the tubular body when changing the configuration of the reclining chair 100.

According to a further preferred aspect, the armrest 30 is a first armrest and the reclining chair 100 according to the present disclosure comprises a second armrest 40. The second armrest 40 is preferably identical to the first armrest 30 and comprises a first portion of the second armrest associated with the seat 10 and a second portion of the second armrest associated with the backrest 20. The first portion of the second armrest and the second portion of the second armrest are sliding relative to each other between at least a first position associated with the raised configuration of the backrest 20 with respect to the seat 10 and a second position associated with a reclined configuration of the backrest 20 with respect to the seat 10. Furthermore, the second armrest 40 further comprises a locking mechanism of the sliding between said first portion of the second armrest and said second portion of the second armrest. Preferably, the locking mechanism of the second armrest 40 is also identical to the locking mechanism 50 of the first armrest 30, and therefore includes all the aspects described above.

According to a further aspect of the present disclosure, it is possible to provide a greater number of locking seats of the locking element 50, in such a way as to allow an adjustment of the configuration of the backrest even in intermediate positions between said raised position and said reclined position.

The present disclosure has as a further object a method for modifying the configuration of a backrest with respect to a seat of a reclining chair at least between a raised position of the backrest with respect to said seat to a reclined position of the backrest with respect to the seat, or vice versa.

In describing this process, the elements of the reclining chair 100 involved in the method and having the same function and the same structure as the elements previously described retain the same reference number and are not again described in detail.

The method according to the present disclosure comprises a step of making a first armrest portion 31 and a second armrest portion 32 slidable relative to each other. This sliding occurs between a first position associated with a raised configuration of the backrest with respect to the seat and a second position associated with a reclined configuration of the backrest with respect to the seat. In particular, the first armrest portion is associated with the seat 10, while the second armrest portion is associated with the backrest.

The method object of the present disclosure, according to a preferred aspect, further comprises a step for locking the sliding between the first armrest portion 31 and the second armrest portion 32 in the first position or in the second position so as to lock the configuration of the backrest in said raised configuration or in said reclined configuration.

The locking step provides for coupling a locking element of a locking mechanism to a first locking seat or to a second locking seat. Specifically, a coupling of the locking element 53 to the first locking seat 51 is associated with the first position, that is to a raised position of the backrest, while a coupling of the locking element 53 to the second locking seat 52 is associated with the second position, i.e. to a reclined position of the backrest 20.

According to a preferred aspect of the present disclosure, the coupling of the locking element 53 to the first locking seat 51 or to the second locking seat 52 takes place by moving a second part 55 of the locking element 53 with respect to a first part 54 of the locking element 53 itself, from a retracted position to an extended position of the second part 55 of the locking element 53 with respect to the first part 54 of the locking element 53, and in this condition an elastic element 63 is loaded.

This movement occurs by means of a second elastic element 56 interposed between said first part 54 and said second part 55 of the locking element 53.

According to a further preferred aspect, the method provides a step of unlocking the sliding between the first portion of armrest 31 and the second portion of armrest 32 to pass from said raised position of the backrest 20 with respect to the seat 10 to the reclined position of the backrest 20 with respect to the session 10, or vice versa. Preferably, this unlocking step takes place by moving the second part 55 of the locking element 53 with respect to a first part 54 of the locking element 53 itself, from an extended position to a retracted position of the second part 55 of the locking element 53 with respect to the first part 54 of the locking element 53. This movement occurs by compressing the second elastic element 56 by means of an actuation device 70.

The object of the present disclosure has so far been described with reference to its embodiments. It is to be understood that other embodiments may exist which pertain to the same inventive core, all falling within the protection scope of the claims set forth below.

The invention claimed is:

1. A reclining chair comprising a seat, a backrest associated with said seat and an armrest, wherein said armrest comprises a first armrest portion associated with said seat and a second armrest portion associated with said backrest, wherein the first armrest portion and the second armrest portion are slidable relative to each other between at least a first position associated with a raised configuration of the backrest with respect to the seat and a second position associated with a reclined configuration of the backrest with respect to the seat; wherein one between said first armrest portion and said second armrest portion is a tubular body having a main development direction and the other between said first armrest portion and said second armrest portion is a body at least partially inserted into said tubular body configured to slide along a sliding direction; the armrest further comprising a locking mechanism of the sliding between said first armrest portion and said second armrest portion, wherein said locking mechanism comprises a first locking seat, a second locking seat and a locking element configured to couple alternately said first locking seat or said second locking seat, wherein a coupling of the locking element with said first locking seat is associated with said first armrest position and a coupling of the locking element with said second locking seat is associated with said second armrest position, and wherein the locking mechanism includes a spring or elastic element, which is adapted to be arranged in a loading condition when the locking element is in the second locking seat and wherein a removal of the locking element from the second locking seat corresponds to a movement of the locking element in the first locking seat and of the backrest to the first position under an action of the spring or elastic element, and wherein said first seat and said second seat are through holes defined in said tubular body and wherein said locking element of the locking mechanism is associated with said inserted body, and wherein said locking element comprises a first part associated with said inserted body and a second part configured to alternately couple said first seat or said second seat, wherein said second part is movable with respect to the first part from a retracted position to an extended position, wherein in said extended position the second part of the locking element is at least partially inserted in one between said first and said second seat and wherein in said retracted position the second part of the locking element is completely inserted in said tubular body.

2. The reclining chair according to claim 1, wherein said first locking seat and said second locking seat are not accessible by an user.

3. The reclining chair according to claim 1, wherein the tubular body defines an inner area of said tubular body and wherein the locking mechanism is arranged in said inner area of the tubular body.

4. The reclining chair according to claim 2, wherein said tubular body comprises a first abutment element and wherein said inserted body comprises a second abutment element, said first abutment element and said second element being arranged aligned along said main development direction (L) of the tubular body to define an end of stroke of the tubular body with respect to the inserted body.

5. The reclining chair according to claim 4, wherein the elastic element or spring is interposed between said first abutment element and said second abutment element to counteract a coming out of the inserted body from said tubular body.

6. The reclining chair according to claim 1, further comprising a second elastic element interposed between said first part of the locking element and said second part of the locking element to keep said second part of the locking element in the extended position.

7. The reclining chair according to claim 6, wherein the tubular body comprises an activation device configured to move the second part of the locking element from the extended position to the retracted position, wherein said activation device comprises a first activation element arranged at said first locking seat and a second activation element arranged at said second locking seat.

8. The reclining chair according to claim 7, wherein said activation device is a tilting body hinged on a pin arranged between said first locking seat and said second locking seat and configured to swing around said pin so that the first activation element abuts against said second part of the locking element at said first locking seat or that the second activation element abuts against said second part of the locking element at said second locking seat.

9. The reclining chair according to claim 8, wherein said tilting body is configured so as said first activation element is arranged at said through hole of said first locking seat so that said through hole in said tubular body is not accessible by a user, and so that said second activation element is arranged at said through hole of said second locking seat so that said through hole in said tubular body is not accessible by a user.

10. The reclining chair according to claim 1, wherein said armrest is a first armrest, the reclining chair further comprising a second armrest made as said first armrest according to claim 1.

11. The reclining chair according to claim 1, wherein said seat and said backrest form a single body, and/or wherein said seat and said backrest are connected together seamlessly and/or wherein said seat and said backrest are connected together without pin elements or hinge elements.

12. The reclining chair according to claim 1, wherein said armrest has a thinning thickness capable of undergoing a localized elastic deformation and optionally allowing a relative rotation of the armrest with respect to a leg of the chair connected in a single piece to the armrest by means of a curve.

* * * * *